US007735185B2

(12) United States Patent
Nam et al.

(10) Patent No.: US 7,735,185 B2
(45) Date of Patent: Jun. 15, 2010

(54) UPRIGHT TYPE VACUUM CLEANER WITH WATER CLEANING FUNCTION

(75) Inventors: Hyeun Sik Nam, Seoul (KR); Young Woo Lee, Seoul (KR); Choon Myun Chung, Gyeonggi-do (KR)

(73) Assignee: LG Electronics Inc., Seoul (KR)

( * ) Notice: Subject to any disclaimer, the term of this patent is extended or adjusted under 35 U.S.C. 154(b) by 1113 days.

(21) Appl. No.: 11/293,118

(22) Filed: Dec. 5, 2005

(65) Prior Publication Data

US 2006/0260088 A1 Nov. 23, 2006

(30) Foreign Application Priority Data

May 17, 2005 (KR) ..... 10-2005-0041338

(51) Int. Cl.
*A47L 11/29* (2006.01)
*A47L 9/18* (2006.01)
*A47L 7/00* (2006.01)

(52) U.S. Cl. ..... 15/320; 15/353

(58) Field of Classification Search ..... 15/320, 15/322, 328, 331, 353, 416
See application file for complete search history.

(56) References Cited

U.S. PATENT DOCUMENTS 4,167,800 A * 9/1979 Tribolet ..... 15/331
4,310,945 A * 1/1982 Tribolet ..... 15/347
4,314,385 A * 2/1982 Wimsatt et al. ..... 15/321
4,580,309 A * 4/1986 Ogden ..... 15/422.2
7,213,297 B2 * 5/2007 Nam et al. ..... 15/334
7,272,869 B1 * 9/2007 Robinson ..... 15/320
7,367,082 B2 * 5/2008 Gordon et al. ..... 15/320
2005/0198763 A1 * 9/2005 Lee et al. ..... 15/320
2005/0262657 A1 * 12/2005 Lee et al. ..... 15/320
2006/0085941 A1 * 4/2006 Lee et al. ..... 15/320

FOREIGN PATENT DOCUMENTS

CN 1264567 A 8/2000
GB 2 320 418 A 6/1998
GB 2 411 823 A 9/2005

* cited by examiner

*Primary Examiner*—David B Thomas
(74) *Attorney, Agent, or Firm*—Birch, Stewart, Kolasch & Birch, LLP

(57) ABSTRACT

An upright type vacuum cleaner having a water cleaning function includes a head portion; a body portion rotatably installed at an upper side of the head portion; a water cleaning unit; and a flow-path changing hose selectively supplying an intake force of the fan motor to the head portion and the water cleaning unit.

9 Claims, 7 Drawing Sheets

UPRIGHT TYPE VACUUM CLEANER WITH WATER CLEANING FUNCTION

BACKGROUND OF THE INVENTION

1. Field of the Invention

The present invention relates to an upright type vacuum cleaner, and particularly, to an upright type vacuum cleaner capable of performing water cleaning besides dry cleaning.

2. Description of the Background Art

In general, an upright type vacuum cleaner allows a user to clean a carpet or a floor with a cleaner main body inclined at a certain angle with respect to a head portion, without user's bending over for the cleaning process.

As shown in FIG. 1, such an upright type vacuum cleaner includes a head portion 11, a body portion 12 rotatably coupled with an upper side of the head portion 11, a handle portion 18 extending from the body portion 12, and an intake hose 17 connecting the head portion 11 with the body portion 12.

The head portion 11 receives dust from a surface to be cleaned in contact therewith, and has at its bottom, an air intake hole (not shown) for receiving dust.

The body portion 12 includes a cylindrical case frame 13, a collecting container 14 detachably installed at the case frame 13 and having a filter 15 for filtering only dust from a mixture of air and dust introduced through the intake hose 17, a fan motor (not shown) generating an intake force, and a discharge hole 16 through which the air having been filtered through the filter 15 is discharged.

A user holds the handle portion 18 and performs a cleaning process, repetitively pulling and pushing the upright type vacuum cleaner in a standing posture. Here, dust on a surface to be cleaned is introduced to the intake hose 17 through the air intake hole (not shown) of the head portion 11, is filtered by the filter 15 of the container 14, and then is collected.

If the surface to be cleaned is a textile such as a carpet or a curved surface, water cleaning that water is spread onto the surface to be cleaned and cleans the surface is more effective than the dry cleaning that dust on the surface to be cleaned is simply drawn in.

However, a special water cleaning device, such as an extractor, is required to perform the water cleaning. Thusly, an addition expense occurs for the extractor, and securing of an additional space is required to keep the extractor.

BRIEF DESCRIPTION OF THE INVENTION

Therefore, an object of the present invention is to provide an upright type vacuum cleaner capable of performing water cleaning without a special water cleaning device such as an extractor.

To achieve these and other advantages and in accordance with the purpose of the present invention, as embodied and broadly described herein, there is provided an upright type vacuum cleaner having a water cleaning function, the vacuum cleaner comprising: a head portion having an air intake hole through which dust on a surface to be cleaned is received; a body portion rotatably installed at an upper side of the head portion and including a fan motor generating an intake force for receiving dust from the surface to be cleaned and a water pump generating a spreading force for spreading water onto the surface to be cleaned; a water cleaning unit including a washing water container storing water to be supplied to the water pump, a nozzle portion spreading water, which is stored within the washing water container, onto the surface to be cleaned with a spreading force of the water pump, a polluted water intake portion receiving polluted water on the surface to be cleaned by an intake force of the fan motor, a polluted water container storing the received polluted water, and a polluted water intake hose connecting the polluted water intake portion with the polluted water container; and a flow-path changing hose selectively supplying an intake force of the fan motor to the head portion and the water cleaning unit.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a unit of this specification, illustrate embodiments of the invention and together with the description serve to explain the principles of the invention.

In the drawings.

DETAILED DESCRIPTION OF THE INVENTION

Reference will now be made in detail to the preferred embodiments of the present invention, examples of which are illustrated in the accompanying drawings.

Figure 1:
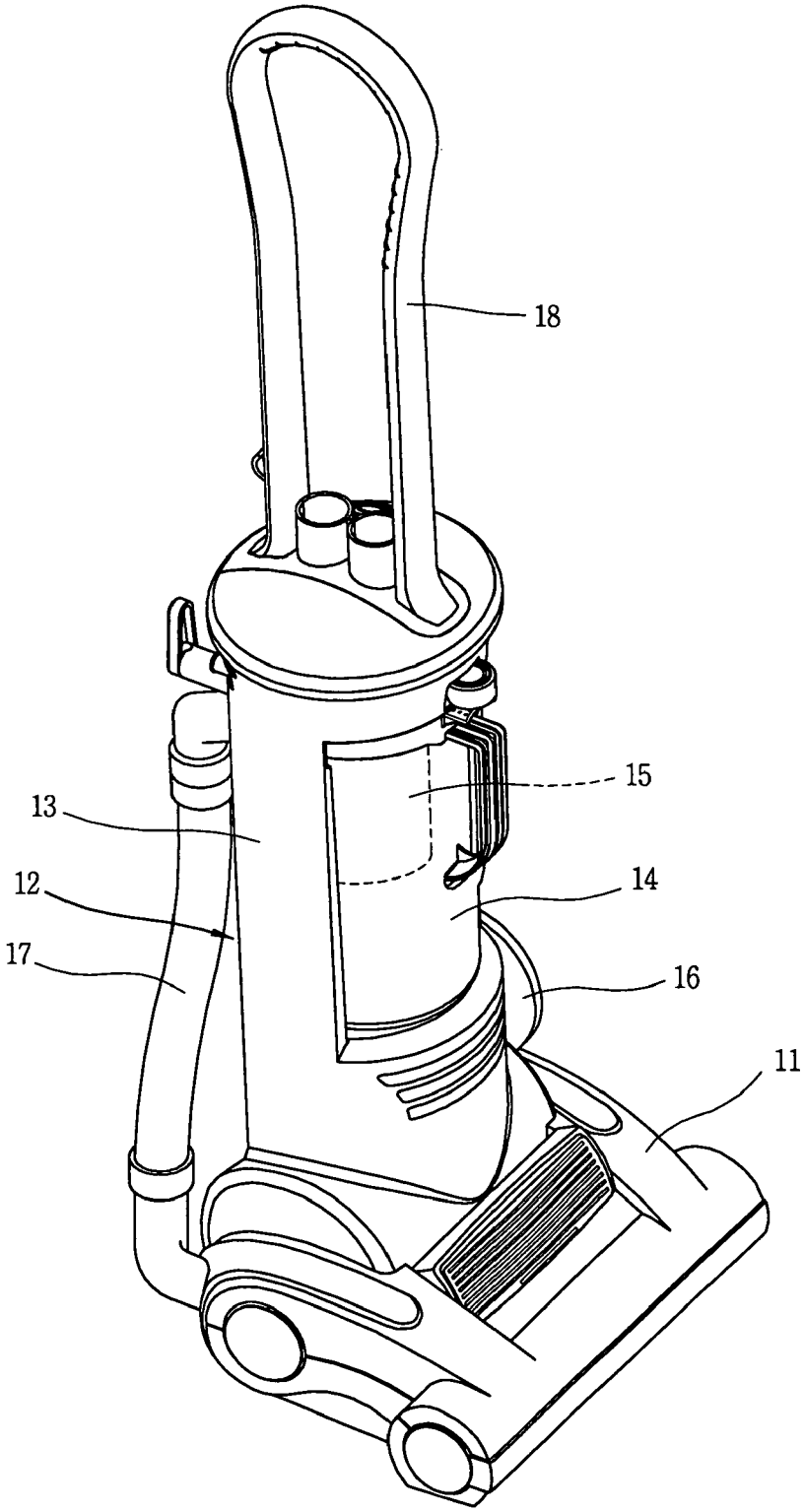
FIG. 1 CONVENTIONAL ART
FIG. 1 is a perspective view of a conventional upright type vacuum cleaner.
Figure 2:
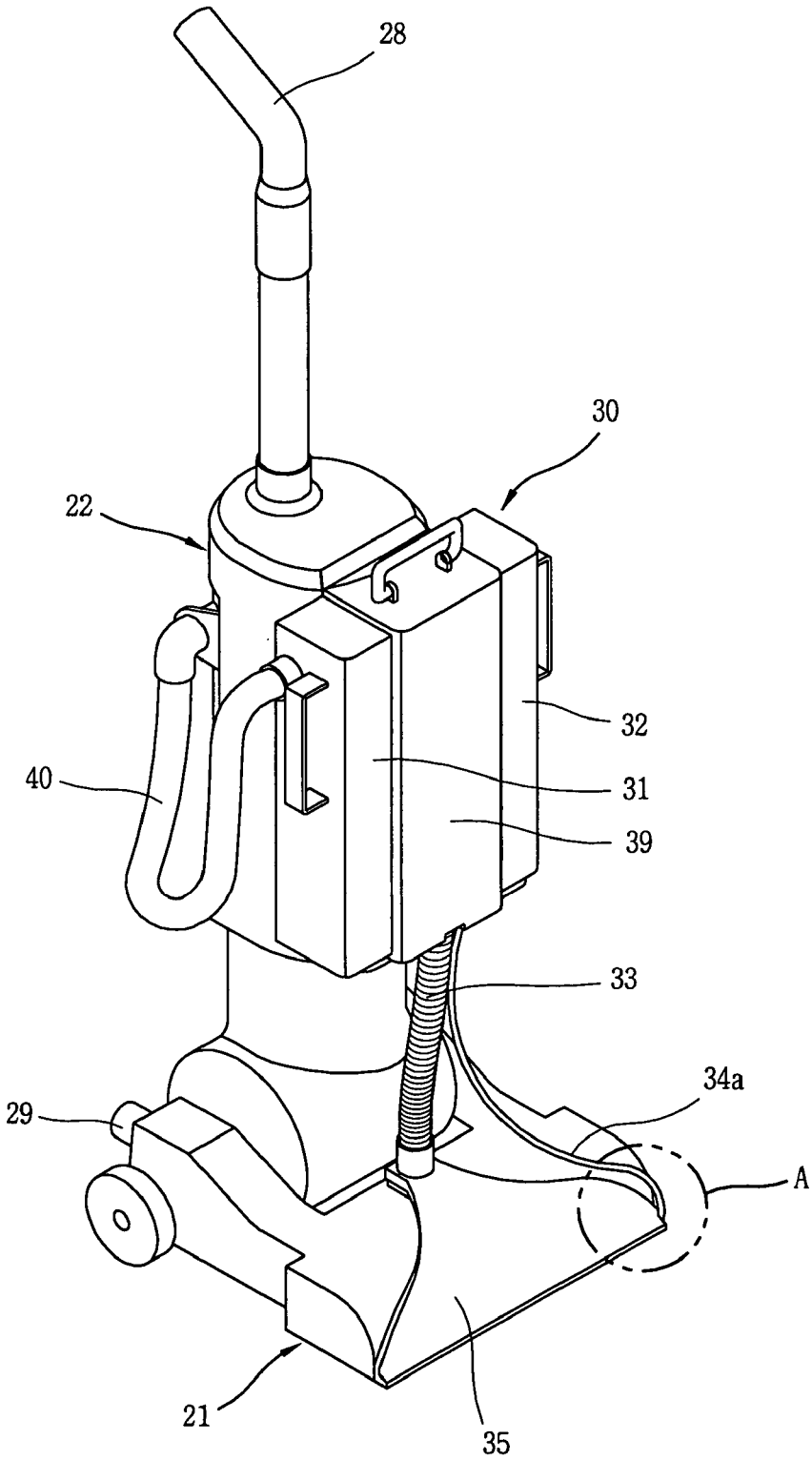
FIG. 2 is a perspective view of an upright type vacuum cleaner having a water cleaning function in accordance with one embodiment of the present invention.
Figure 3:
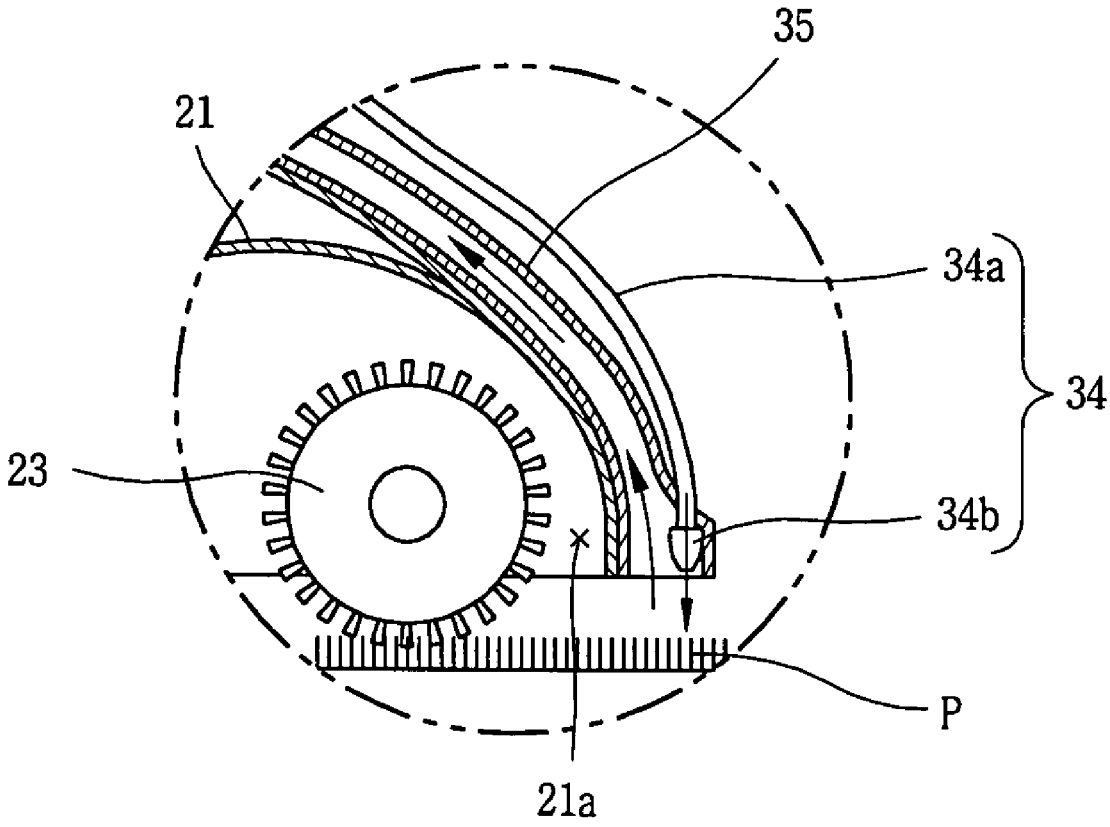
FIG. 3 is an enlarged view of part A indicated by a dotted line in FIG. 2.

FIG. 2 is a perspective view of an upright type vacuum cleaner having a water cleaning function in accordance with one embodiment of the present invention, and FIG. 3 is an enlarged view of part A indicated by a dotted line in FIG. 2.

Referring to FIGS. 2 and 3, the upright type vacuum cleaner includes a head portion 21, a body portion 22, a water cleaning unit 30 and a flow-path changing hose 40.

The head portion 21 receives dust on a surface (P) to be cleaned in contact with the surface to be cleaned. To this end, an air intake hole 21*a* through which dust is received is formed at a lower side of the head portion 21. A brush 23 that can hit, scratch and separate the dust from the surface to be cleaned is rotatably installed at the air intake hole 21*a*.

The body portion 22 is rotatably installed at an upper side of the head portion 21. A handle 28 that the user holds to push and pull the cleaner is installed at an upper side of the body portion 22. The body portion 22 has therein a fan motor (not shown) generating an intake force for receiving dust on a surface to be cleaned, a water pump 60 (refer to FIG. 6) providing the water cleaning unit 30 with a spreading force for spreading water onto the surface to be cleaned, and a collecting portion (not shown) separating and collecting the dust. Here, the collecting portion (not shown) may be constructed in various forms of a paper bag, a cyclone collecting device or the like.

The water cleaning unit 30 includes a frame 39, a polluted water container 31, a washing water container 32, a nozzle portion 34, a polluted water intake portion 35 and a polluted water intake hose 33.

Figure 4:
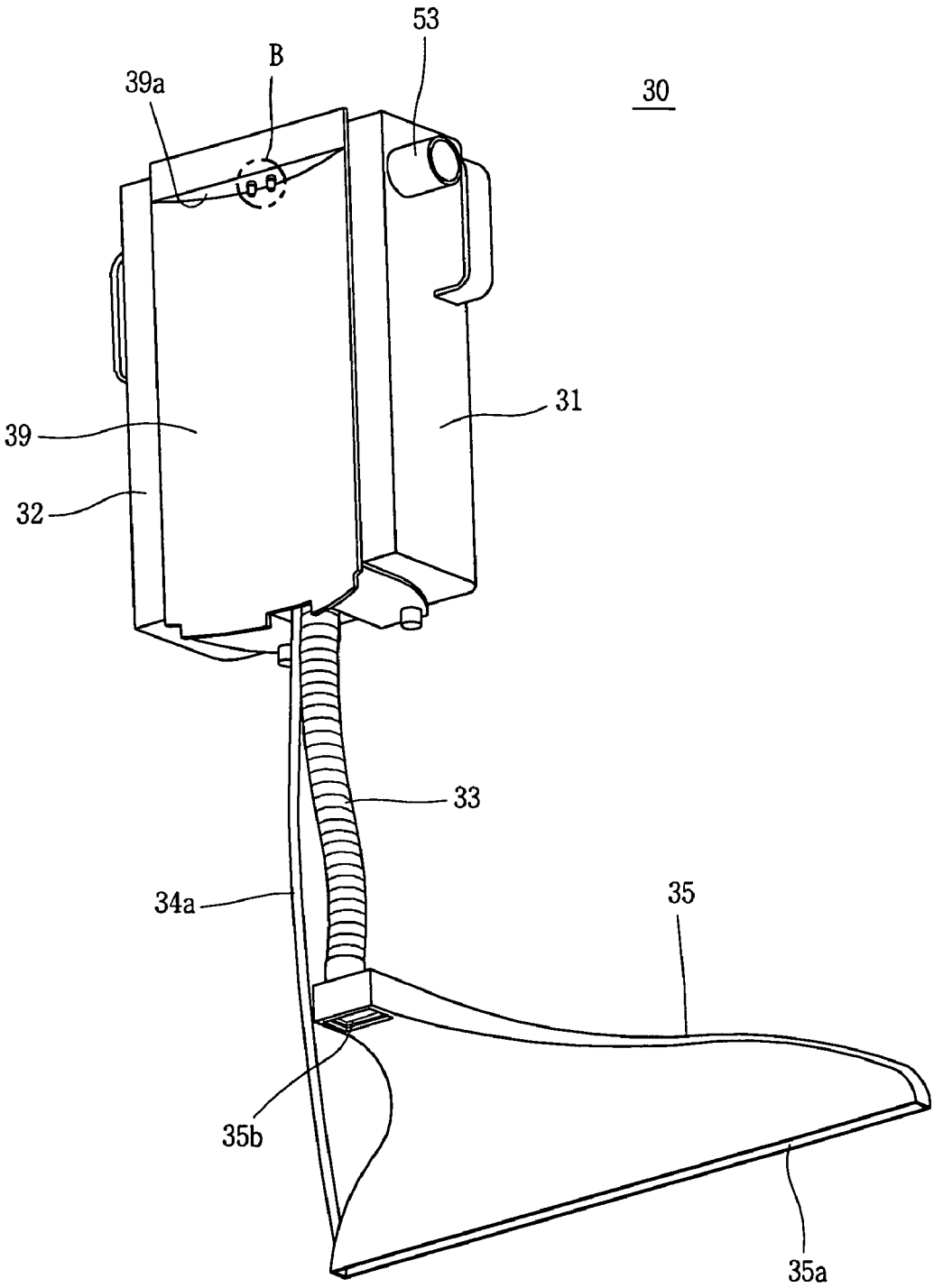
FIG. 4 is a perspective view which exclusively illustrates a water cleaning unit of FIG. 2.
Figure 5:
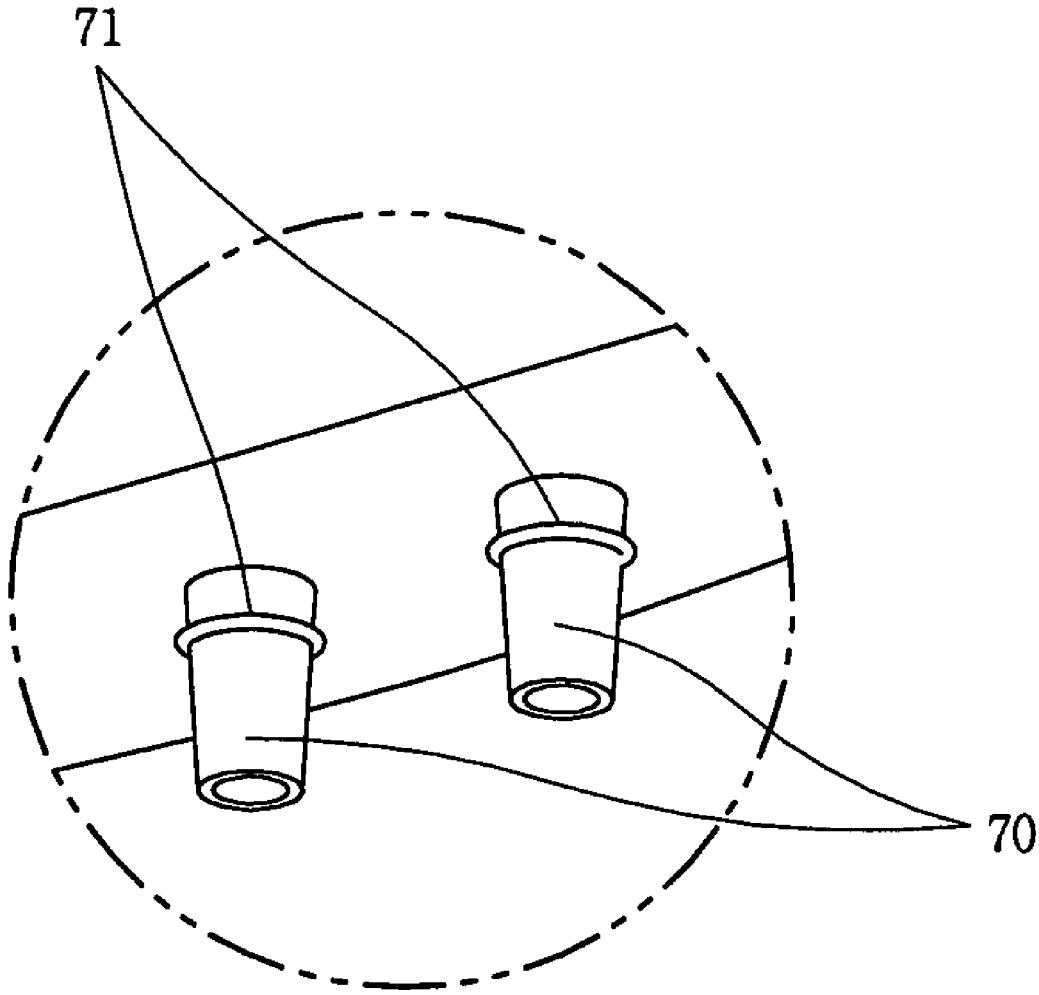
FIG. 5 is an enlarged view of part B indicated by a dotted line in FIG. 4.
Figure 6:
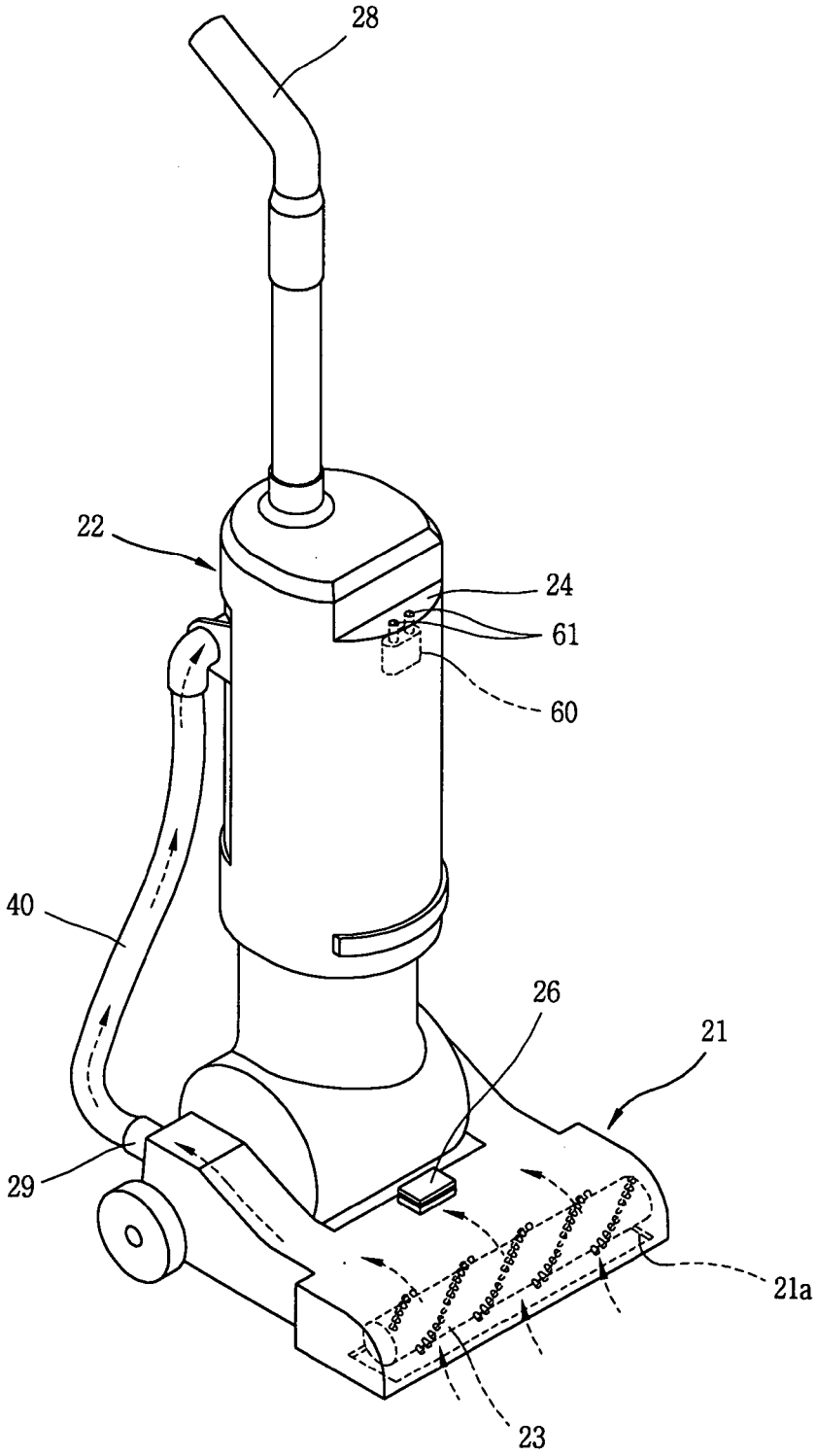
FIG. 6 is a view that illustrates the upright type vacuum cleaner excluding the water cleaning unit for the purpose of explaining dry cleaning of the cleaner.

FIG. 4 is a perspective view which exclusively illustrates the water cleaning unit, FIG. 5 is an enlarged view of part B indicated by a dotted line in FIG. 4, and FIG. 6 is a view that illustrates the upright type vacuum cleaner excluding the water cleaning unit for the purpose of explaining dry cleaning of the cleaner.

Referring to FIGS. 4 to 6, the frame 39 is detachably installed at the body portion 22. A frame step 39*a* is formed at an upper portion of the frame 39 such that the frame 39 can be hung on the body portion 22, and a body step 24 corresponding thereto is formed at the body portion 22.

A frame connector 70 protrudes downwardly from the frame step 39*a*.

A body connector 61 (refer to FIG. 6) is formed at the body step 24 as a groove that receives the frame connector 70. Here, as shown in FIG. 5, the frame connector 70 is tapered toward an upper end in view of its outer diameter so as to be pressingly inserted into the body side connector 61 by a weight of the frame 39 and thusly be hermetically sealed.

Also, a sealing member 71 for making coupling of the frame connector 70 and the body connector 61 firmer is installed at an outer circumferential surface of the frame connector 70.

If the frame step 39*a* is hung on the body step 24, the washing water container 32 and the nozzle portion 34 are connected to the water pump 60 by the frame connector 70 and the body connector 61. Thusly, a flow path allowing water in the washing water container 32 to be spread outside through a nozzle portion 34 via the water pump 60 is completed.

As described above, because the water cleaning unit 30 is mounted to the body portion 22 and the flow path is completed only by the operation of putting down the frame on the body portion 22 and inserting the frame connector 70 to the body connector 61, the user can easily mount the water cleaning unit 30 to the body portion 22 (refer to FIG. 2) and complete the flow path without making uncomfortable postures like bending over to mount the water cleaning unit to the body portion 22.

Figure 7:
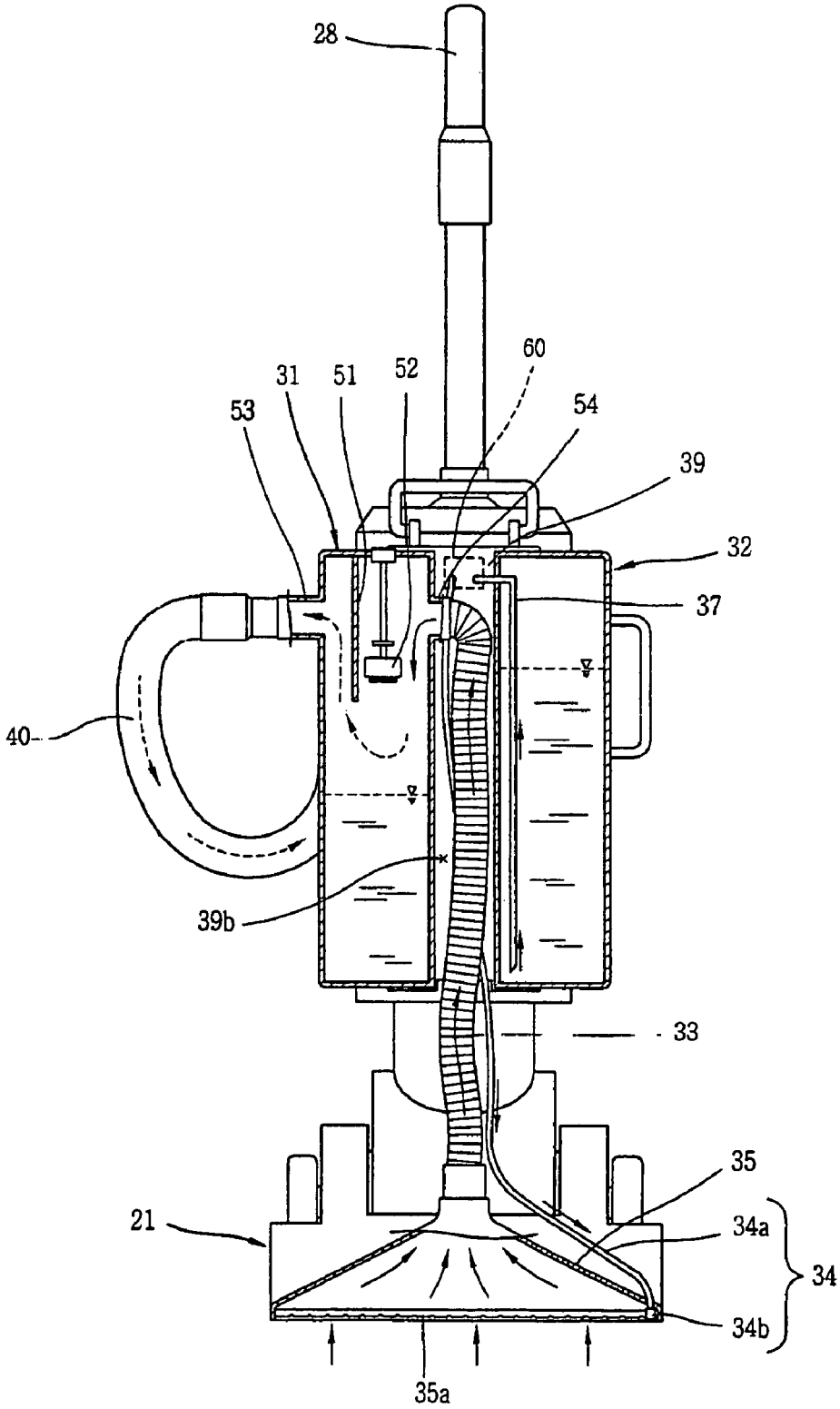
FIG. 7 is a view that illustrates a polluted water container, a washing water container and a polluted water intake portion which are cut out for the purpose of explaining operation of the upright type vacuum cleaner in water cleaning.

FIG. 7 is a view that illustrates a polluted water container, a washing water container and a polluted water intake portion which are cut out for the purpose of explaining operation of the upright type vacuum cleaner in water cleaning.

With reference to FIG. 7, a central passage 39*b* is formed at the center of the frame 39, through which a polluted water intake hose 33 passes, and a polluted water container 31 and a washing water container 32 are mounted at both sides of the central passage 39*b*.

The polluted water container 31 is detachably fixed to the left side of the frame, and stores water polluted by being mixed with dust and introduced via the polluted water intake portion 35 and the polluted water intake hose 33 (hereinafter, such water is referred to as polluted water).

An air discharge hole 53 selectively connected to a flow-path changing hose 40 is formed at one side of the polluted water container 31, and a polluted water inlet hole 54 connected to the polluted water intake hose 33 is formed at the other side.

A partition plate 51 having a certain length is installed inside the polluted water container 31 and suspended downwardly from a ceiling of the polluted water container 31 so as to prevent polluted water introduced through the polluted water inlet hole 54 from being directly discharged to the air discharge hole 53.

A float switch 52 for preventing back flow of the polluted air to the polluted water inlet hole 54 and the air discharge hole 53 is installed inside the polluted water container 31. The float switch 52 stops the cleaner by sending a signal thereto when a level of the polluted water exceeds a certain level.

The washing water container 32 is detachably fixed to the right side of the frame 39 and stores water to be supplied to the water pump 60. An inlet pipe 37 extending to the bottom of the washing water container 32 is installed inside the washing water container 32 so as to send stored water to the water pump 60.

The nozzle portion 34 spreads water stored within the washing water container 32 onto the surface to be cleaned, by using a spreading force of the water pump 60. To this end, the nozzle portion 34 includes a water supply hose 34*a* and a nozzle 34*b* mounted to an end of the water supply hose 34*a*.

The polluted water intake portion 35 is detachably installed at an upper side of the head portion 21, and draws in the polluted water by using an intake force of the fan motor (not shown) of the body portion 22. To this end, a polluted water intake hole 35*a* is formed at a lower side of the polluted water intake portion 35.

Referring to FIGS. 4 and 6, a mounting groove 35*b* is formed at a bottom of the polluted water intake portion 35, and a mounting protrusion 26 corresponding thereto is formed at an upper surface of the heat portion 21. Needless to say, a mounting protrusion 26 may be formed at the bottom of the polluted water intake portion 35, and a mounting groove 35*b* corresponding thereto may be formed at the upper surface of the heat portion 21. Such a polluted water intake portion 35 is connected to the polluted water container 31 by the polluted water intake hose 33.

With reference to FIGS. 6 and 7, the flow-path changing hose 40 selectively supplies an intake force of the fan motor (not shown) to the head portion 21 or the water cleaning unit 30 (refer to FIG. 4).

To this end, in the dry cleaning, as shown in FIG. 6, the user connects the flow-path changing hose 40 to a connection port 29 of the head portion 21. In this case, the intake force of the fan motor (not shown) is transferred to the head portion 21.

Meanwhile, in the water cleaning, as shown in FIG. 7, the flow-path changing hose 40 is connected to the air discharge hole 53 of the polluted water container 31. In this case, the intake force of the fan motor (not shown) is transferred to the polluted water intake portion 35 via the polluted water container 31 and the polluted water intake hose 33.

Referring to FIGS. 6 and 7, the operation of the upright type vacuum cleaner having a water cleaning function in accordance with one embodiment of the present invention will now be described. An arrow indicates the flow of the air.

First, the operation of the upright type vacuum cleaner in the dry cleaning will now be described.

Referring to FIG. 6, the user connects the flow-path changing hose 40 to the connection port 29 of the head portion 21. In this case, dust on the surface to be cleaned is hit and scratched by a brush 23 and then collected into a filth collecting chamber (not shown) of the body portion 22 via the air intake hole 21*a* and the flow-path changing hose 40 by an intake force of the fan motor (not shown).

The operation of the upright type vacuum cleaner in the water cleaning using water will now be described.

Referring to FIG. 7, the user separates the flow-path changing hose 40 from the connection port 29 of the head portion 21, and then connects it to the air discharge hole 53 of the polluted water container 31. Then, the water pump 60 is operated.

Water filled in the washing water container 32 passes through the inlet pipe 37 and the water pump 60 and is spread to a surface to be cleaned through the water supply hose 34*a* and the nozzle 34*b* by a spreading force of the water pump 60.

Here, the polluted water is stored in the polluted water container 31 via the polluted water intake hole 35*a* and the polluted water intake hose 33 by an intake force of the fan motor (not shown). The air received together therewith passes the filth collecting chamber (not shown) of the body portion 22 (refer to FIG. 6) and is discharged outside through the flow-path changing hose 40 connected to the air discharge hole 53.

As described so far, the upright type vacuum cleaner having a water cleaning function in accordance with the present invention can selectively perform the dry cleaning and the water cleaning even without a special washing device because it integrally includes the water cleaning unit 30. Accordingly, a special water cleaning device for water cleaning, such as an extractor, is not required, which reduces a cost. Also, conveniently, securing of an additional space for keeping the extractor is not required.

Also, the water cleaning unit 30 is mounted to the body portion 22 and a flow path through which water flows is completed only by putting down the frame 39 on the body portion 22. Accordingly, a user can easily mount the water cleaning unit 30 to the body portion 22 and complete the flow path without making unnecessary postures such as bending over to mount the water cleaning unit 30 to the body portion 22.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An upright type vacuum cleaner having a water cleaning function, the vacuum cleaner comprising:

a head portion having an air intake hole through which dust on a surface to be cleaned is received;

a body portion rotatably installed at an upper side of the head portion and including a fan motor generating an intake force for receiving dust on the surface to be cleaned and a water pump generating a spreading force for spreading water onto the surface to be cleaned;

a water cleaning unit including a washing water container storing water to be supplied to the water pump, a nozzle portion spreading water, which is stored within the washing water container, onto the surface to be cleaned with a spreading force of the water pump, a polluted water intake portion receiving polluted water from the surface to be cleaned by an intake force of the fan motor, a polluted water container storing the received polluted water, and a polluted water intake hose connecting the polluted water intake portion with the polluted water container, a frame detachably installed at the body portion; and a flow-path changing hose selectively supplying an intake force of the fan motor to the head portion and the water cleaning unit;

wherein a central passage through which the polluted water intake hose passes is formed at the center of the frame, and the polluted water container and the washing water container are respectively mounted to both sides of the central passage.

2. The vacuum cleaner of claim 1, wherein one side of the flow-path changing hose is connected to and communicates with the fan motor of the body portion, and the other side of the flow path-changing hose is selectively connected to an air discharge hole of the polluted water container and a connection port of the head portion.

3. The vacuum cleaner of claim 2, wherein a frame step allowing the frame to be hung on the body portion is formed at an upper portion of the frame, and a body step corresponding thereto is formed at the body portion.

4. The vacuum cleaner of claim 3, wherein a frame connector protrudes downwardly from the frame step, and a body connector for receiving the frame connector is installed at the body step.

5. The vacuum cleaner of claim 4, wherein an outer diameter of the frame connector is tapered toward its upper end.

6. The vacuum cleaner of claim 5, further comprising:

a sealing member installed at an outer circumferential surface of the frame connector.

7. The vacuum cleaner of claim 1, wherein an air discharge hole connected to the flow-path changing hose is formed at one side of the polluted water container, and a polluted water inlet hole connected to the polluted water intake hose is formed at the other side thereof.

8. The vacuum cleaner of claim 7, further comprising:

a partition plate installed in the polluted water container, for preventing polluted water, which has been introduced from the polluted water inlet hole, from being directly discharged through the air discharge hole.

9. The vacuum cleaner of claim 7, wherein the polluted water container has a float switch for preventing back flow of the polluted water to the polluted water inlet hole and the air discharge hole.

* * * * *